US005119710A

United States Patent [19]

Tsurumi et al.

[11] Patent Number: 5,119,710

[45] Date of Patent: Jun. 9, 1992

[54] MUSICAL TONE GENERATOR

[75] Inventors: Kanehisa Tsurumi; Hirokazu Kato, both of Hamamatsu, Japan

[73] Assignee: Nippon Gakki Seizo Kabushiki Kaisha, Hamamatsu, Japan

[21] Appl. No.: 650,980

[22] Filed: Feb. 1, 1991

Related U.S. Application Data

[63] Continuation of Ser. No. 366,237, Jun. 12, 1989, abandoned, which is a continuation of Ser. No. 22,977, Mar. 6, 1987, abandoned.

[30] Foreign Application Priority Data

Mar. 9, 1986 [JP] Japan ..... 61-50929
Apr. 24, 1986 [JP] Japan ..... 61-95470
Apr. 24, 1986 [JP] Japan ..... 61-95471

[51] Int. Cl.[5] ..... G10H 7/00

[52] U.S. Cl. ..... 84/615; 84/600; 84/601; 84/602; 84/622

[58] Field of Search ..... 84/600, 603, 656, 670, 84/644; 307/231

[56] References Cited

U.S. PATENT DOCUMENTS

| | | | |
|---|---|---|---|
| Re. 31,931 | 7/1985 | Tomisawa | 84/1.01 |
| 4,041,825 | 8/1977 | Pascetta | 84/1.01 |
| 4,185,531 | 1/1980 | Oberheim et al. | 84/1.19 X |
| 4,365,532 | 12/1982 | Nakada et al. | 84/1.19 |
| 4,373,416 | 2/1983 | Endo et al. | 84/1.01 |
| 4,387,617 | 6/1983 | Kato et al. | 84/1.01 |
| 4,476,766 | 10/1984 | Ishii | 84/1.19 X |
| 4,497,235 | 2/1985 | Momoshima et al. | 84/1.19 |
| 4,502,359 | 3/1985 | Sano | 84/1.01 X |
| 4,539,883 | 9/1985 | Chihana | 84/1.01 X |
| 4,577,540 | 3/1986 | Yamana | 84/665 |
| 4,700,605 | 10/1987 | Minamitaka | 84/662 |
| 4,703,680 | 11/1987 | Wachi et al. | 84/1.01 X |
| 4,773,294 | 9/1988 | Iizuka et al. | 84/615 X |
| 4,788,896 | 12/1988 | Uchiyama et al. | 84/624 |
| 4,791,847 | 12/1988 | Nishimoto | 84/622 |
| 4,805,511 | 2/1989 | Schwartz | 84/627 |

*Primary Examiner*—A. T. Grimley
*Assistant Examiner*—Matthew S. Smith
*Attorney, Agent, or Firm*—Blakely, Sokoloff, Taylor & Zafman

[57] ABSTRACT

A musical tone generator includes first and second tone generator units respectively having a plurality of musical tone generation channels, a designating device for designating tone colors of musical tones, and a CPU for enabling respective tone generation channels to be selectively assigned with different tone colors. The usage of the plural tone generator units is also controlled by discriminating whether or not the input performance data can be processed by the first tone generator unit. When the CPU determines that the input performance data can be processed by the first tone generator unit, it controls musical tone production in the first tone generator unit based on the performance data. When the CPU determines that the input performance data cannot be processed by the first tone generator unit, it controls musical tone production in the second tone generator unit based on the performance data.

3 Claims, 10 Drawing Sheets

| | 1 | 2 | 3 | 4 | 5 | 6 | 7 | 8 |
|---|---|---|---|---|---|---|---|---|
| CHASR (M) | 1 | 1 | 1 | 0 | 0 | 0 | 0 | 0 |

FIG.3

| | 1 | 2 | 3 | 4 | 5 | 6 | 7 | 8 |
|---|---|---|---|---|---|---|---|---|
| CHSTR (M) | KC | 0 | KC | 0 | 0 | 0 | 0 | 0 |

FIG.4

| | | |
|---|---|---|
| TGCR (M) | CONTROL MODE | CONTROL PARAMETER |

FIG.5

| | |
|---|---|
| | TONE COLOR NUMBER |
| | MODULATION |
| | TONE VOLUME |
| CONTM (M) | PANNING POTENTIOMETER |
| | PORTAMENTO |
| | DETUNE |
| | PITCH BEND |
| | ⋮ |

FIG.6

MUSICAL TONE GENERATOR

This is a continuation of U.S. application Ser. No. 366,237 filed June 12, 1989, which is a continuation of U.S. application Ser. No. 022,977 filed Mar. 6, 1987, both now abandoned.

BACKGROUND OF THE INVENTION

The present invention relates to a musical tone generator suited for an electronic musical instrument system and, more particularly, to an improvement of a tone generator controller.

As a conventional tone generator having a plurality of musical tone generation channels, a PCM (pulse code modulation) tone generator, an FM (frequency modulation) tone generator, and the like are known. In either type of generator, a same tone color such as a piano is commonly assigned to all of the available channels, e.g., eight channels.

With the prior art technique, even if eight channels are provided for a piano tone color, a performer may use less than 8 channels, e.g., 5 channels, according to his will or a musical piece to be performed, and the remaining channels are left nonused. It is understood that if, e.g., a strings tone color is assigned to the remaining channels, an effective performance is allowed. However, such a tone color assignment cannot be performed in the prior art technique.

In the prior art generator described above, input performance data is indiscriminately received, the presence/absence of an empty channel in a plurality of channels (e.g., 8 channels) is checked, and the input performance data is assigned to the empty channel.

With the prior art technique, the number of musical tones that can be produced at the same time is restricted by the number of channels. For example, when eight channels are arranged, a maximum of eight tones can be simultaneously produced and nine or more tones cannot be simultaneously produced.

Recent electronic musical instruments are often constituted by discrete components. In other words, a keyboard, a sequencer, a music computer, a tone generator unit, and the like are combined to constitute a musical instrument system. In a musical instrument system of this type, a demand often arises for increasing the number of channels according to extension of a keyboard and the like.

In order to satisfy such a demand, a tone generator unit or units may be extended. However, if they are simply extended, the number of musical tones that can be produced at the same time cannot be increased. More specifically, if a plurality of tone generator units each having a plurality of channels are arranged, and given performance data is input thereto, each tone generator unit indiscriminately receives the performance data to execute musical tone generation processing. Therefore, a plurality of tones having pitches corresponding to the performance data can be parallel-generated from the plurality of tone generator units. These tones essentially correspond to one tone since they have the same pitch. For example, even if two tone generator units each having eight channels are arranged, a maximum of only eight tones can be simultaneously produced.

In such a case, in order to increase the number of musical tones that can be simultaneously produced, the arrangement and processing mode of the tone generator unit or units can be updated to correspond to an increased number (e.g., 16) channels. However, it is very inconvenient to perform such updating every time a tone generator unit or units are extended.

SUMMARY OF THE INVENTION

It is the principle object of the present invention to provide a musical tone generator capable of assigning arbitrary tone colors or other parameters to selected one or plural channels of a tone generator having a plurality of channels for producing musical tones, thereby effectively utilizing channels and improving performance effects.

It is another object of the present invention to provide a tone generator control which can facilitate extension of tone generator units.

In order to achieve the above objects, there is provided a musical tone generator, comprising: a tone generator unit having a plurality of musical tone generation channels; storage means for storing tone control data for a plurality of tone colors; input means for inputting, for each tone color, channel assignment data for designating a channel to which a tone color is to be assigned and performance data necessary for producing a musical tone of that tone color; selection means for selecting a channel to be assigned from the plurality of channels based on the input channel assignment data; readout means for reading out, from the storage means, control data for that tone color in accordance with the input channel assignment data; assignment means for assigning the tone control data read out from the storage means to the selected channel; and control means for controlling, in the selected channel, musical tone generation of the tone generator unit based on the input performance data and the tone color control data read out from the storage means.

With the above arrangement, a plurality of tone generator units can be arranged, and each tone generator unit discriminates, based on received control data, whether or not performance data is to be received, thereby controlling production of musical tones, so that the number of tone generation channels can be easily increased.

According to another aspect of the present invention, there is provided a musical tone generator, comprising: a tone generator unit having a plurality of musical tone generation channels; first storage means for storing tone control data for a plurality of tone colors; input means for inputting channel assignment data for designating a channel to be assigned to each tone color, tone color designating data for designating a tone color used in an assigned channel, and performance data necessary for producing a musical tone of that tone color; second storage means for storing input tone color designating data; selection means for selecting a channel to be assigned from the plurality of channels based on the input channel assignment data; readout means for reading out tone control data corresponding to the tone color designating data stored in the second storage means from the first storage means; assignment means for assigning the readout tone control data to the selected channel; and control means for controlling, in a channel to which tone control data of the designated tone color is assigned, musical tone generation of the tone generator unit based on the input performance data and the tone control data read out from the storage means.

With the above arrangement, when channel assignment data corresponding to a desired tone color is input, the desired tone color can be assigned to a desired channel, and various performance states effectively utilizing channels can be obtained. As the channel assignment data, data representing a required number of channels or channel number can be used.

According to still another aspect of the present invention, there is provided a musical tone generator comprising: a plurality of tone generator units for producing musical tones; storage means for storing received control data for each of the tone generator units; input means for inputting performance data; discrimination means for discriminating based on received control data corresponding to each of the tone generator units whether or not input performance data can be received; and control means for controlling musical tone production based on the performance data in the tone generator unit of the plurality of tone generator units, which is determined to be capable of receiving the input performance data.

With this arrangement, tone generation processing is controlled by discriminating whether or not input performance data can be received based on reception control data for each tone generator unit. Therefore, when the tone generator unit is extended, this can be coped with only by changing the reception control data, and the arrangement and processing of the tone control unit need not be updated. For example, when the number of tone generator units is increased from one to two, the content of the reception control data can be determined for each tone generator unit so as to selectively receive individual performance data by two tone generator units. With this arrangement, the number of tones that can be produced at the same time can be increased up to the total number of channels of both the tone generator units.

The reception control data stored in the storage means can be input from the input means for each tone generator unit. With this arrangement, the number of tone generator units can be increased/decreased during performance.

According to still another aspect of the present invention, there is provided a musical tone generator comprising: first and second tone generator units respectively having a plurality of musical tone generation channels; input means for inputting performance data; discrimination means for discriminating whether or not the input performance data can be processed by the first tone generator unit; and control means for, when the discrimination means determines that the input performance data can be processed by the first tone generator unit, controlling musical tone production in the first tone generator unit based on the performance data, and for, when the discrimination means determines that the input performance data cannot be processed by the first tone generator unit, controlling musical tone production in the second tone generator unit based on the performance data.

With this arrangement, if the performance data cannot be processed by the first tone generator unit, it can be transferred to and processed by the second tone generator unit. Therefore, if the number of tone generator units is increased from one to two, the arrangement and processing of the tone control unit need not be changed. The number of musical tones that can be produced at the same time can be increased up to a maximum of the total number of channels of both the tone generator units.

BRIEF DESCRIPTION OF THE DRAWINGS

FIG. 3 is a view showing the storage content of a channel assignment register;

FIG. 4 is a view showing the storage content of a channel status register;

FIG. 5 is a view showing the storage content of a tone generator control data register;

FIG. 6 is a memory map showing the storage content of a musical tone control data memory;

DESCRIPTION OF THE PREFERRED EMBODIMENTS

Figure 1:
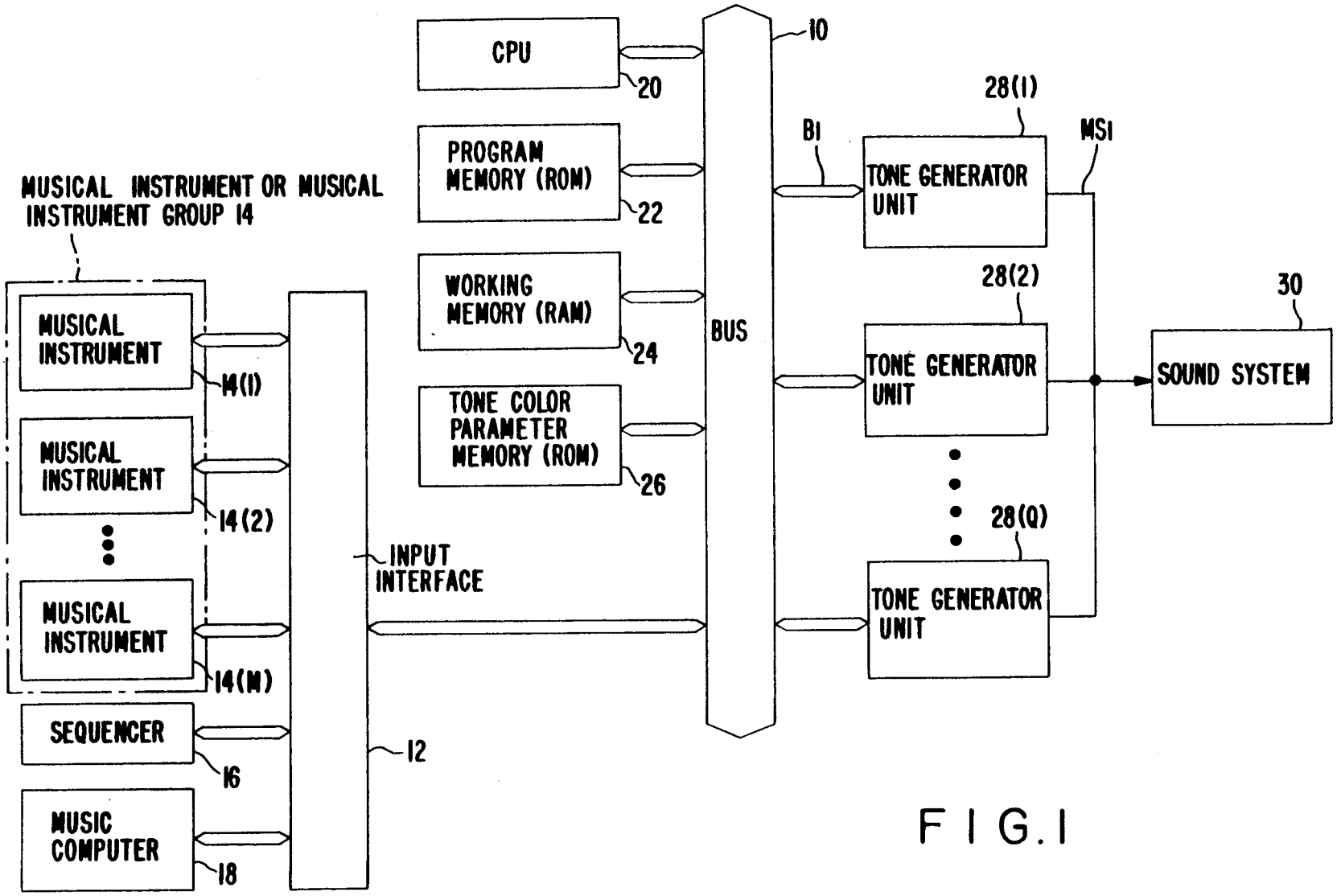
FIG. 1 is a block diagram showing the arrangement of a musical tone generator according to an embodiment of the present invention.

FIG. 1 shows the overall arrangement of a musical tone generator according to an embodiment of the present invention. In this musical tone generator, assignment of musical tone control data to respective channels, generation of performance tones, and the like are controlled by a microcomputer.

Overall Arrangement (FIG. 1)

To a bus 10 are connected a musical instrument or musical instrument group 14, a sequencer (automatic performance device), and a music computer 18 through an input interface 12.

The musical instrument group 14 includes M musical instruments 14(1) to 14(M), and each instrument is connected to the bus 10 through the input interface 12. Each musical instrument has a keyboard and various operation members. The operation members related to the present invention include a tone color designating operation member, operation members for setting musical tone parameters, e.g., volume, effects, and the like, a channel number designating operation member, a musical tone unit number designating operation member, a control mode designating operation member, and the like. In the keyboard, a key switch and a touch sensor are provided for each key.

The musical instrument group 14 can be a single electronic musical instrument comprising a plurality of keyboards, such as an upper keyboard, a lower keyboard, a pedal keyboard, and the like, and the above-mentioned various operation members. In this case, if a tone color designation is allowed for each keyboard, a single musical instrument can be defined for each keyboard. This also applies to the case wherein a single keyboard is divided into a plurality of key regions, and a tone color designation is allowed for each key region. Therefore, in these cases, a single electronic musical instrument includes M musical instruments.

The sequencer 16 carries out an automatic performance based on performance data stored in, e.g., a memory. The performance data can be utilized instead of or together with performance data from the keyboards of the musical instrument or musical instrument group 14. The sequencer 16 can have the various operation members described above. In this case, the sequencer 16 is also treated as a single musical instrument.

The music computer 18 is suited for the so-called MIDI (Musical Instrument Digital Interface) standards, and can input data corresponding to the above-mentioned various operation members. In addition, if one or plurality of keyboards are connected to the computer 18, the performance data can also be input. Therefore, the computer 18 can be treated as a single musical instrument or as M musical instruments as well as the musical instrument or musical instrument group 14.

The bus 10 is also connected to a central processing unit (CPU) 20, a program memory 22, a working memory 24, a tone parameter memory 26, and Q tone generator units 28(1) to 28(Q).

The CPU 20 executes various types of processing such as channel assignment, musical tone generation, and the like in accordance with a program stored in the program memory 22 comprising a ROM (Read-Only Memory). These processing operations will be described later in detail with reference to FIGS. 9 to 15.

The working memory 24 comprises a RAM (Random-Access Memory), and includes storage regions used as registers during the various processing operations executed by the CPU 20. Registers i, j, q, A, and the like (to be described later) are included in the memory 24.

The tone color parameter memory 26 comprises a ROM or RAM, and stores tone color parameter data corresponding to a larger number of tone colors (larger than M). The tone color parameter data corresponding to one tone color is composed of a plurality of parameter data such as a total level, an attack rate, a decay rate, and the like, and is used for modifying or fine-controlling parameters of a tone of each color.

The tone generator units 28(1) to 28(Q) are of an FM tone synthesis type. Each unit has eight musical tone generation channels. The units 28(1) to 28(Q) have the same structure, and the structure of the unit 28(1) will be described later with reference to FIG. 2.

These tone generator units can be independently used in actual application. In this embodiment, Q units are used. Since these units are marketed independently, a user can combine a desired number of tone generator units as needed.

A sound system 30 includes an output amplifier, a loudspeaker, and the like, and converts analog musical tone signals from the tone generator units 28(1) to 28(Q) into musical tones.

Figure 2:
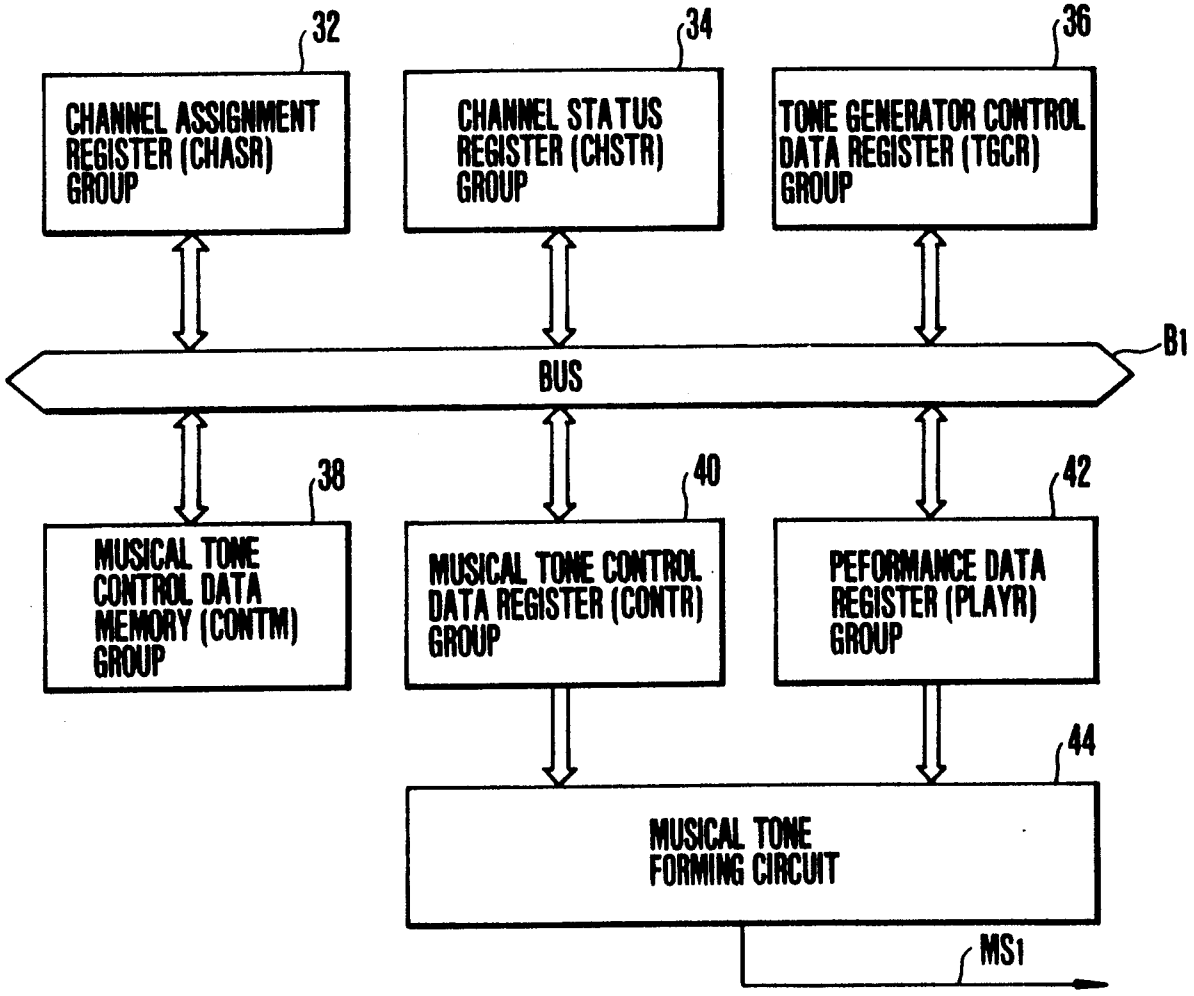
FIG. 2 is a block diagram showing an arrangement of a tone generator unit.

Structure of Musical Tone Unit (FIG. 2)

FIG. 2 shows the structure of the tone generator unit 28(1). A unit bus $B_1$ is connected to a channel assignment register (CHASR) group 32, a channel status register (CHSTR) group 34, a tone generator control data register (TGCR) group 36, a musical tone control data memory (CONTM) group 38, a musical tone control data register (CONTR) group 40, and a performance data register (PLAYR) group 42.

The channel assignment register group 32 includes M channel assignment registers CHASR corresponding to the M musical instruments (M tone colors). Each register has 8-bit storage cells corresponding to channels 1 to 8, as shown in FIG. 3. Each storage cell stores data "1" or "0", thereby representing the presence/absence of tone color assignment to the corresponding channel.

The channel status register group 34 includes M channel status registers CHSTR corresponding to the M musical instruments. Each register has 8-channel storage sections corresponding to the channels 1 to 8, a shown in FIG. 4. Each storage section stores a key code KC or "0", thereby representing use or nonuse (empty state) of the corresponding channel. The key code KC is predetermined for each key of the keyboard, and is included as pitch data in the performance data. Note that data "1" or "0" can be stored so as to represent use or nonuse state of a channel.

The tone generator control data register group 36 includes M tone generator control data registers TGCR corresponding to the M musical instruments. Each register stores control mode designation data and control parameter data, as shown in FIG. 5.

The musical tone control data memory group 38 includes M musical tone control data memories CONTM corresponding to the M musical instruments. Each memory comprises a RAM, and stores tone color number data which basically establishes each tone color, modulation control data, volume control data, panning-potentiometer control data, portamento control data, detune control data, pitch-bend control data, and the like, as shown in FIG. 6. The panning-potentiometer control data is used for controlling sound image localization when a plurality of loudspeakers are used. The detune control data is used for obtaining a chorus effect or flanger effect by slightly shifting a musical tone frequency.

The musical tone control data register group 40 includes eight musical tone control data registers CONTR corresponding to eight channels. Each register stores tone color parameter data, modulation control data, tone volume control data, panning-potentiometer control data, and the like. Tone color parameter data is read out from the tone color parameter memory 26 in accordance with a designated tone color (tone color number data) to modify the tone of that tone color, and other data such as the modulation control data are transferred from the memories of the memory group 38 corresponding to the designated tone color. When the tone color parameter data is set in one or a plurality of registers of the register group 40, tone color assignment to one or a plurality of channels corresponding to the registers can be achieved.

The performance data register group 42 includes eight performance data register PLAYR corresponding to the eight channels. Each register stores ON/OFF status data, the key code KC, and initial touch data. When the ON/OFF status data is data ON ("1"), it represents that a musical tone is to be generated, and if it is data OFF ("0"), it represents that a musical tone generation is to be interrupted. The key code KC is used for controlling a pitch of a musical tone. The initial touch data represents the strength of a key depression, and is used for controlling an envelope of a musical tone.

A musical tone forming circuit 44 constitutes a tone generation section together with the register groups 40 and 42, and includes the eight musical tone generation channels. For example, tone color parameter data corresponding to a piano tone color and musical tone parameters associated therewith are stored in the musical tone control data registers CONTR corresponding to the channels 1 to 3, and ON status data, the key code KC, and the initial touch data are stored in the performance data register PLAYR corresponding to, e.g., channel 1. In this case, a digital musical tone signal of the piano tone color is formed in channel 1 of the musical tone forming circuit 44. The pitch of the digital musical tone signal is determined by the key code KC in the register PLAYR, its envelope is controlled in accordance with the initial touch data in the register PLAYR, and its tone volume, effects, and the like are controlled in accordance with the tone volume control data, detune control data, and the like in the register CONTR. In this case, since the piano tone color is assigned to three channels, a maximum of three musical tones of the piano tone color can be generated at the same time.

The digital musical tone signal generated for each channel is sent from the musical tone forming circuit 44 as an analog musical tone signal $MS_1$ via processing for adding the signals for a plurality of channels, A/D conversion processing, and the like. The musical tone signal $MS_1$ is supplied to the sound system 30, and is produced as a musical tone.

Figure 9:
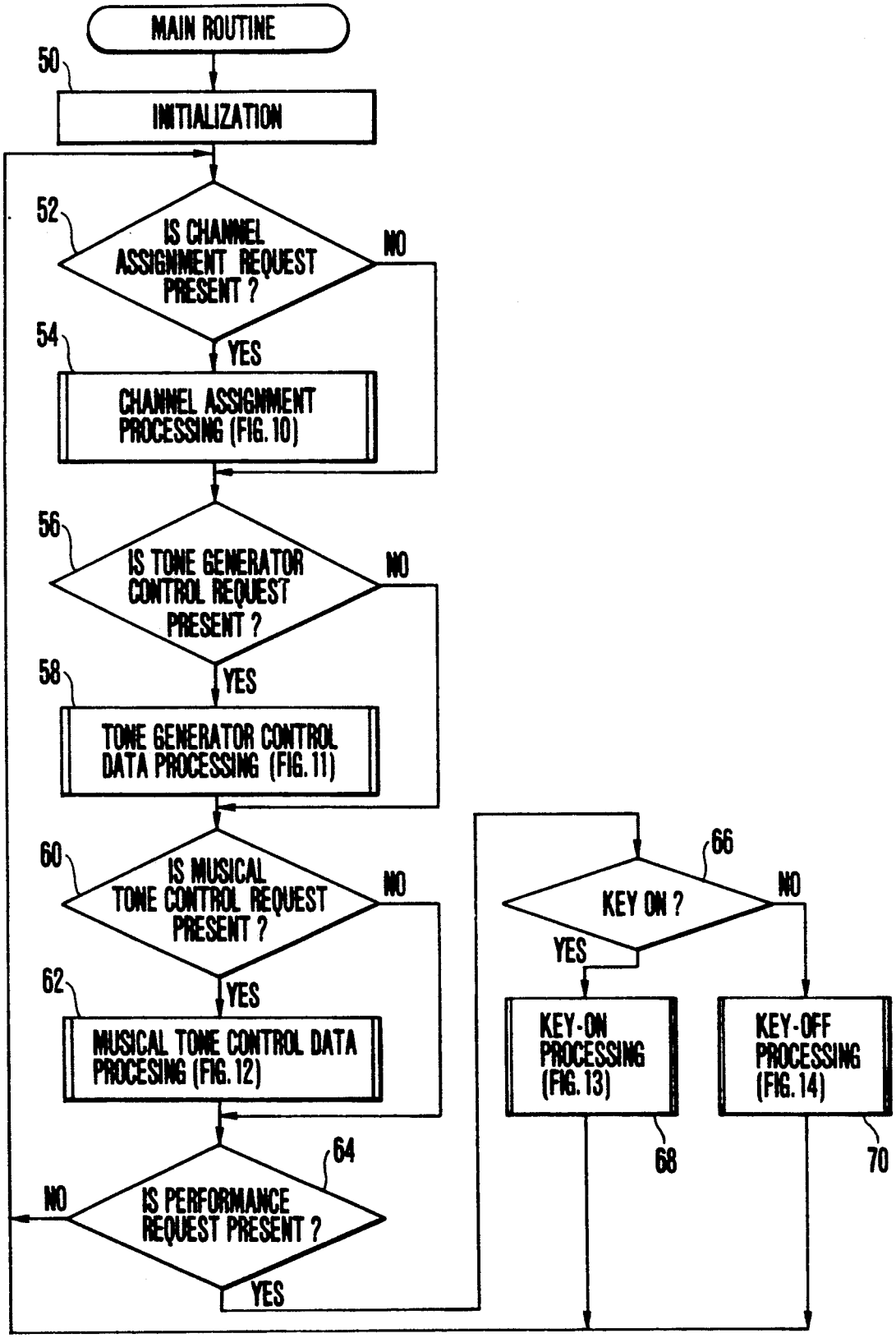
FIG. 9 is a flow chart showing the main routine.

Main Routine (FIG. 9)

FIG. 9 shows the processing of the main routine. In step 50, initialization is performed in response to turning on of a power source, thereby initializing the various registers. For example, musical tone control data of the corresponding musical instruments are set in the M memories of the memory group 38, and the registers of the registers groups 32, 34, 36, 40, and 42 are cleared. In this case, appropriate initial data can be set in the registers of the register groups 32, 36, and 40 in order to immediately allow a performance.

It is checked in step 52 if a channel assignment request is present. The channel assignment request is generated based on the operation of the tone generator unit number designating operation member and the channel number designating operation member for each musical instrument, and a musical instrument number, a unit number, and the number of channels are input.

If Y in step 52, i.e., if the channel assignment request is present, the flow advances to step 54, and channel assignment processing is performed as will be described later with reference to FIG. 10. Then, the flow advances to step 56. If N in step 52, i.e., if no channel assignment request is present, the flow jumps to step 56 without executing step 54.

It is checked in step 56 if the tone generator control request is present. The tone generator control request is generated based on the operations of the tone generator unit number designating operation member and the control mode designating operation member, and a musical instrument number, a unit number, a control mode value, a control parameter, and the like are supplied as the input data.

If Y in step 56, i.e., if the tone generator control request is present, the flow advances to step 58, and tone generator control data processing is performed as will be described later with reference to FIG. 11. The flow then advances to step 60. If N in step 56, i.e., if no tone generator control request is present, the flow jumps to step 60 without executing step 58.

It is checked in step 60 if a musical tone control request is present. The musical tone control request is generated upon operations of the tone generator unit number designating operation member, the tone color designating operation member and/or the operation members for setting musical tone parameters such as a tone volume, an effect, and the like, and a musical tone number, a unit number, a tone color number, and/or musical tone parameters are supplied as the input data.

If Y in step 60, i.e., if the musical tone control request is present, the flow advances to step 62, and musical tone control data processing is executed as will be described later with reference to FIG. 12. The flow then advances to step 64. If N in step 60, i.e., no musical tone control request is present, the flow jumps to step 64 without executing step 62.

It is checked in step 64 if a performance request (key-on or key-off) is present. The performance request is generated based on keyboard operation and/or the readout operation from the memory for each musical instrument (e.g., in the case of the sequencer 16), and a musical instrument number, the key code KC, an initial touch, and the like are supplied as the input data. In this case, if the initial touch is 0, it represents a key-off.

If N in step 64, the flow returns to step 52, and the above-mentioned processing is repeated. If Y in step 64, the flow advances to step 66.

It is checked in step 66 if key-on data is present. If Y in step 66, i.e., if the key-on data is detected, the flow advances to step 68, and key-on processing is executed as will be described later with reference to FIG. 13. If N in step 66, the flow advances to step 70, and key-off processing is executed, as will be described later with reference to FIG. 14.

After step 68 or 70 is completed, the flow returns to step 52, and the above-mentioned processing is repeated.

Figure 10:
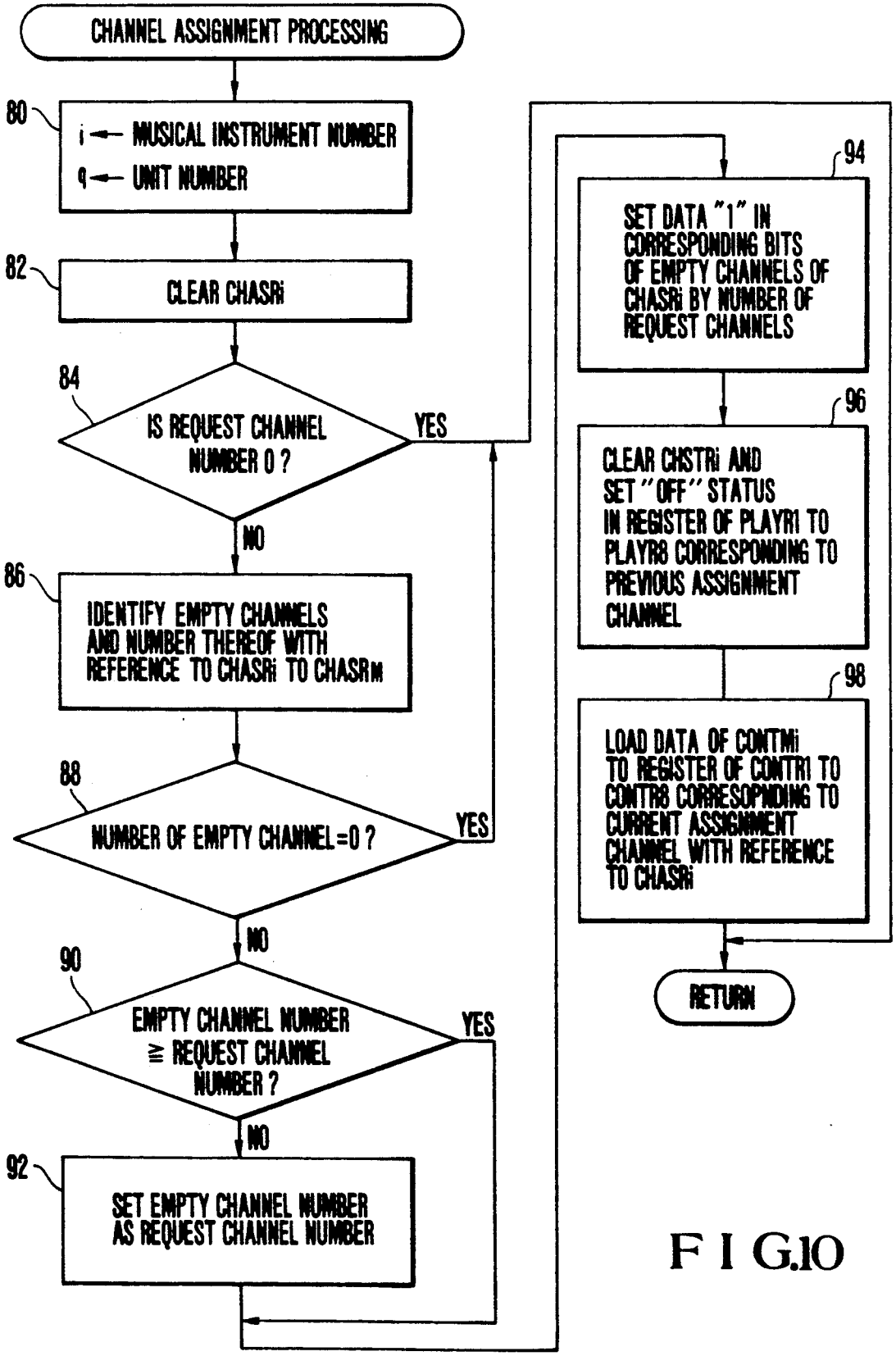
FIG. 10 is a flow chart showing the subroutine of channel assignment processing.

Channel Assignment Processing (FIG. 10)

The channel assignment processing shown in FIG. 10 is executed when the channel assignment request is generated from a specific musical instrument with respect to a specific tone generator unit. In step 80, a musical instrument number (any one of 1 to M) is set in the register i, and a unit number (any one of 1 to Q) is set in the register q. For the sake of simplicity, if a musical instrument number is given as i and a unit number is given as q, the processing, which will be described below with reference to FIG. 10, is performed using the registers which are associated with the tone generator unit of the unit number q and correspond to the musical instrument number i.

In step 82, a channel assignment register $CHASR_i$ corresponding to the musical instrument number i is cleared. As a result, if an assigned channel is present, a bit corresponding to the channel is set to "0". The flow then advances to step 84.

It is checked in step 84 if the number of request channels is 0. If Y in step 84, i.e., if the number of request channels is 0, the flow returns to the main routine shown in FIG. 9. If N in step 84, the flow advances to step 86.

In step 86, the channel assignment registers $CHASR_1$ to $CHASR_M$ are looked up, thereby identifying empty channels and the number of these empty channels. The flow advances to step 88.

It is checked in step 88 if the number of empty channels is 0. If Y in step 88, this represents that all the eight channels of the registers $CHASR_1$ to $CHASR_M$ other than the register $CHASR_i$ are assigned (i.e., there is no empty channel), and the flow returns to the main routine shown in FIG. 9. If N in step 88, this means that there is an unassigned channel, and the flow advances to step 90.

It is checked in step 90 if the number of empty channels is larger than the number of request channels. If N in step 90, this means the number of empty channels is short, and the number of empty channels is set as the number of request channels in step 92. More specifically, the number of request channels is decreased to correspond to the number of empty channels, and the flow then advances to step 94. If Y in step 90, the flow advances to step 94 without executing step 92.

In step 94, bits of the register $CHASR_i$ corresponding to the empty channels are set to be "1" on the ascending order of channel numbers in correspondence with the number of request channels. As a result, one or a plurality of channels are assigned to the musical instrument of the musical instrument number i.

In step 96, the channel status register $CHSTR_i$ corresponding to the musical instrument number i is cleared. As a result, newly assigned channels are set in the non-used state. OFF status data are set in the registers corresponding to previously assigned channels of the 8-channel performance registers $PLAYR_1$ to $PLAYR_8$, thereby stopping musical tones which are being produced. Then, the flow advances to step 98.

Figure 7:
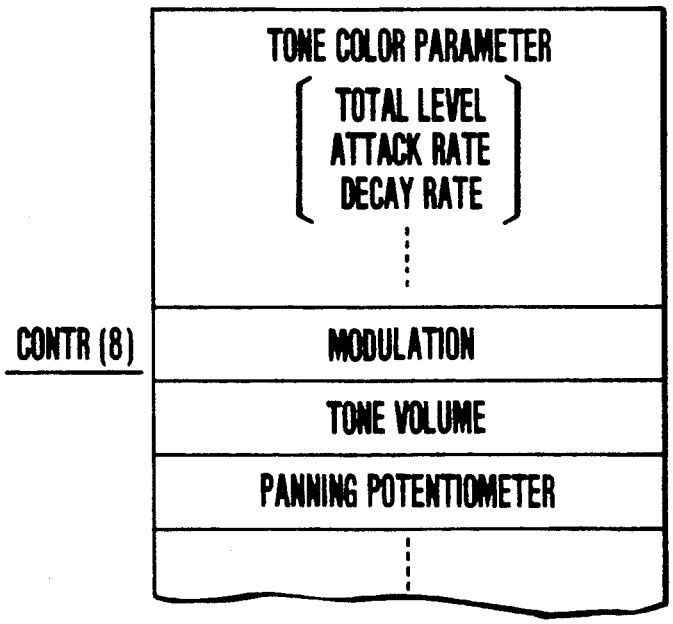
FIG. 7 is a view showing the storage content of a musical tone control data register.
Figure 8:
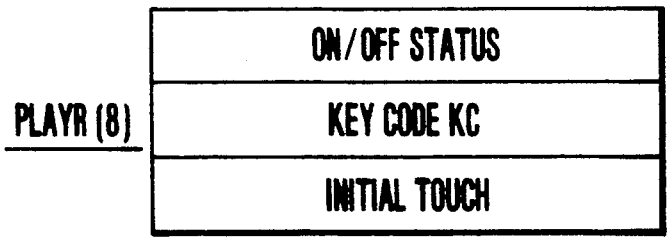
FIG. 8 is a view showing the storage content of a performance data register.

In step 98, the musical tone control data in the musical tone control data memory $CONTM_i$ corresponding to the musical instrument number i is loaded to the ones of the 8-channel musical tone control registers $CONTR_1$ to $CONTR_8$ corresponding to the current assigned channels with reference to the register $CHASR_i$, as shown in FIG. 7. As a result, the piano tone color and musical tone parameters associated therewith are assigned to the channels 1 to 3 of, e.g., the tone generator unit 28(1). After step 98, the flow returns to the main routine shown in FIG. 9.

With the processing shown in FIG. 10, an identical tone color or different tone colors and musical tone parameters associated therewith can be assigned to eight channels of each tone generator unit.

Figure 11:
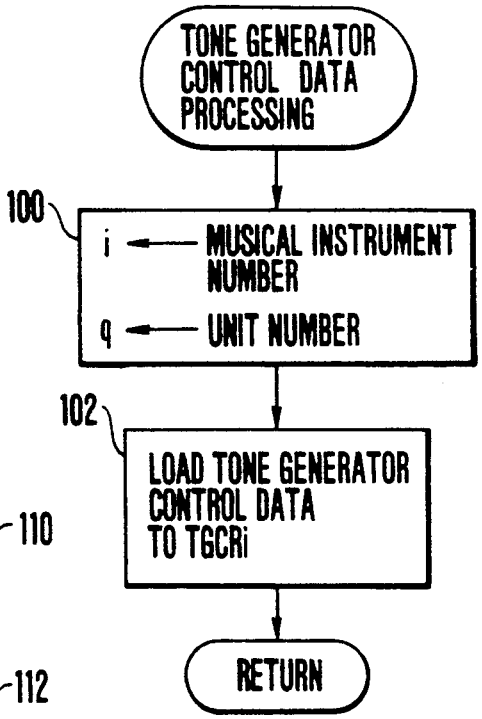
FIG. 11 is a flow chart showing the subroutine of tone generator control data processing.

Tone Generator Control Data Processing (FIG. 11)

The tone generator control data processing shown in FIG. 11 is executed when a tone generator control request is supplied from a specific musical instrument to a specific tone generator unit. In step 100, a musical instrument number associated with the control request is set in the register i, and a unit number associated with the control request is set in the register q.

In step 102, tone generator control data is loaded into the tone generator control data register $TGCR_i$ corresponding to the musical instrument number i, in the musical generator unit of the unit number q. Then, the flow returns to the main routine shown in FIG. 9.

Figure 13:
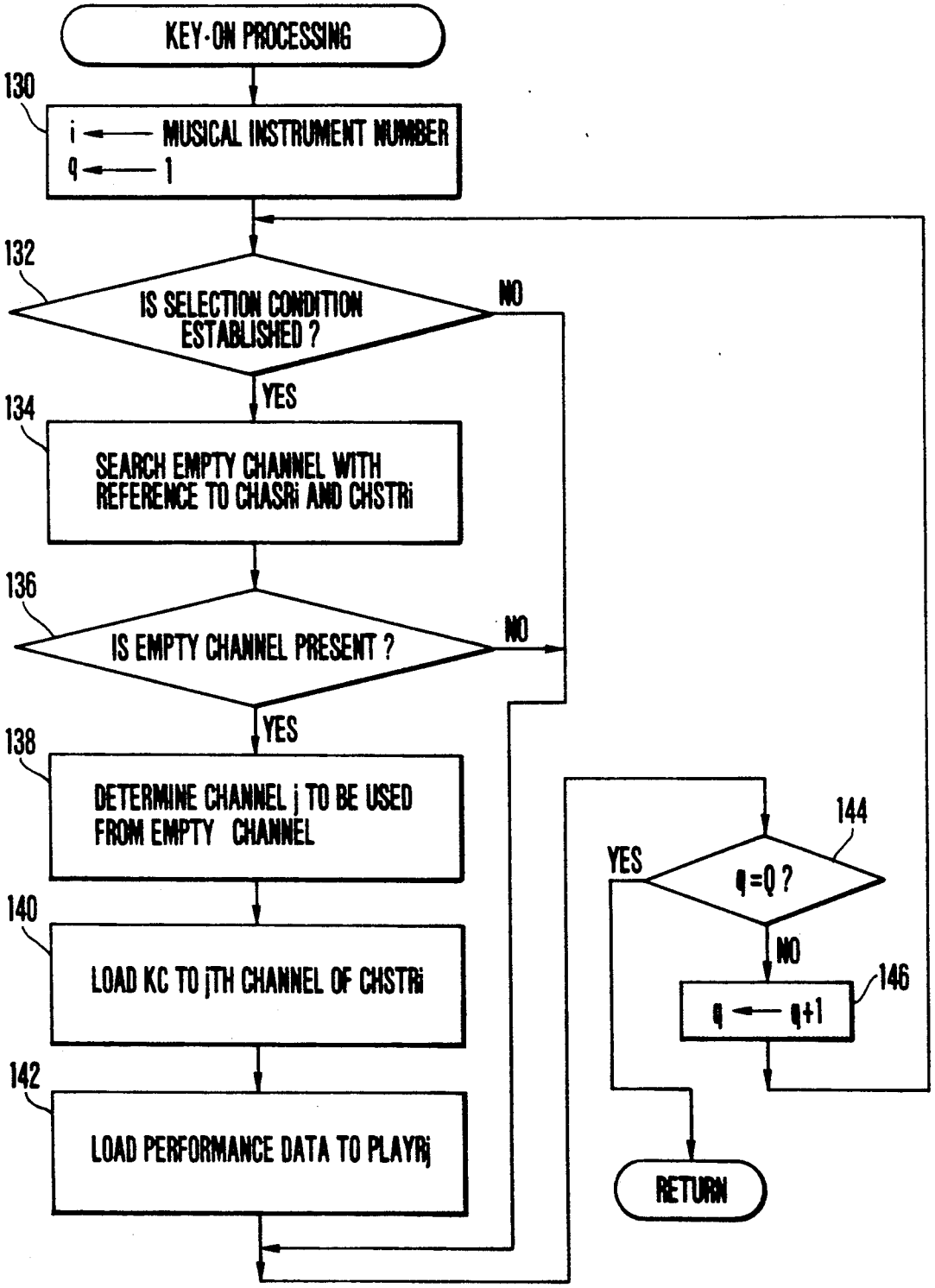
FIG. 13 is a flow chart showing the subroutine of key-on processing.
Figure 15:
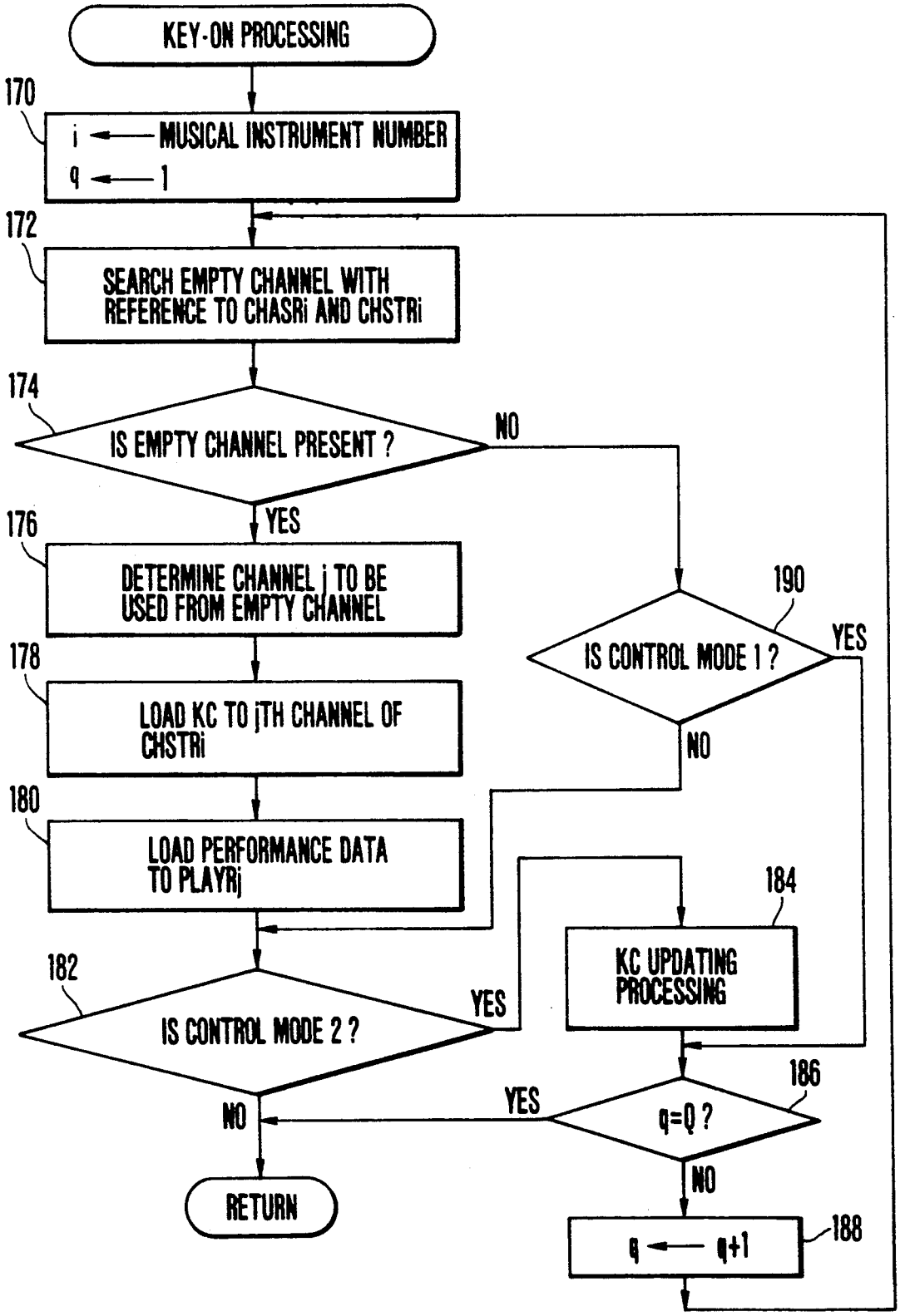
FIG. 15 is a flow chart showing the subroutine of key-on processing according to another embodiment of the present invention.

In the processing shown in FIG. 11, the content of the tone generator control data loaded into the register $TGCR_i$ differs in accordance with the case wherein the processing shown in FIG. 13 is employed and the case wherein the processing shown in FIG. 15 is employed.

When the processing shown in FIG. 13 is employed, since input performance data is selectively received by a plurality of tone generator units, a selection condition therefor must be determined. The selection condition determination methods are as follows:

(1) A selection method depending on whether the value of the key code KC is an even or odd number This method can be used when two tone generator units are used.

(2) A selection method in accordance with a remainder (integer) obtained by dividing the key code KC with an integer n This method can be used when n tone generator units are used. For example, if n=4 (modulo 4), the remainder falls within the range of 0 to 3. Therefore, the four tone generator units selectively receive key codes KC corresponding to the remainders 0 to 3.

(3) A selection method with a predetermined reception range of the key code KC

This method can be carried out for the tone generator units corresponding to the number of the reception ranges. For example, when the key region is divided into high and low tone regions, the first tone generator unit receives the key codes KC belonging to the high tone region, and the second tone generator unit receives the key codes KC belonging to the low tone region.

(4) A selection method wherein a key code to be received is predetermined for each tone generator unit With this method, a reception key code table is necessary for each tone source unit. However, the content of the key code table is programmable.

When the above-mentioned methods (1) to (4) are used, the number of musical tones to be produced at the same time can be increased to a maximum of the total number of channels of the plurality of tone generator units.

When the selection methods (1) to (4) are carried out, control mode values are given as 0 to 8, and a reception object for each value can be determined as follows.

| Control Mode Value | Selection Method | Reception Object |
|---|---|---|
| 0 | Not selected | All KCs |
| 1 | (1) | KCs of even numbers |
| 2 | (2) | KCs of odd numbers |
| 3 | (2) | KC of remainder 0 |
| 4 | (2) | KC of remainder 1 |
| 5 | (2) | KC of remainder 2 |
| 6 | (2) | KC of remainder 3 |
| 7 | (3) | KC in designated range |
| 8 | (4) | Individually designated KC |

Any of the control mode values is set in the register $TGCR_i$ as the control mode designating data upon operation of the control mode designating operation member. In the case of the control mode value 7, data for designating a reception range (e.g., data indicating upper- or lower-limit of the reception range) is set as the control parameter data. In the case of the control mode value 8, a reception key code table is set as the control parameter data.

In the case of the control mode value 0, since a plurality of tone generator units parallel-generate musical tone signals in accordance with input performance data, a so-called unison effect can be obtained.

When the processing shown in FIG. 15 is employed, it is checked if input performance data can be processed in a given tone generator unit so as to control musical tone generation of the corresponding tone generator unit and the next tone generator unit. Therefore, a control mode must be designated. For example, the control mode values can be given as 0 to 2, and the control content corresponding to the respective values can be determined as follows:

| Control Mode Value | Control Content |
|---|---|
| 0 | No transfer of data to next unit |
| 1 | Transfer data to next unit when processing is impossible in self-unit |
| 2 | Create new performance data, and transfer it to next unit |

Any of the control mode values is set in the register $TGCR_i$ as the control mode designating data upon operation of the control mode designating operation member. In the case of the control mode value 2, since the key code value is updated to create new performance data, data indicating an updating width is set as the control parameter data.

When the control mode value is 1, the number of musical tones to be produced at the same time can be reliably increased to a maximum of the total number of channels of a plurality of tone generator units. More specifically, with the selection methods (1) to (4) described above, there is no problem when performance data suited for the selection condition is supplied. For example, if several key codes KC of the even numbers are supplied, no tone can be produced from the tone generator units for receiving the key codes of the odd numbers, and the number of the musical tones to be generated cannot be reliably increased. However, in the method wherein the data is transferred to the next unit when processing is impossible in the self-unit, the number of tones to be generated can be reliably increased in any case.

When the control mode value is 2, modulation control and the like can be performed by appropriately determining the updating width. If three tone generator units are arranged, so that performance data with changed pitch is transferred from the first to second unit, and from the second to third unit, a desired chord can be produced. If performance data whose musical instrument number is changed is transferred to the next unit, tones of the same pitch can be produced in different tone colors.

Figure 12:
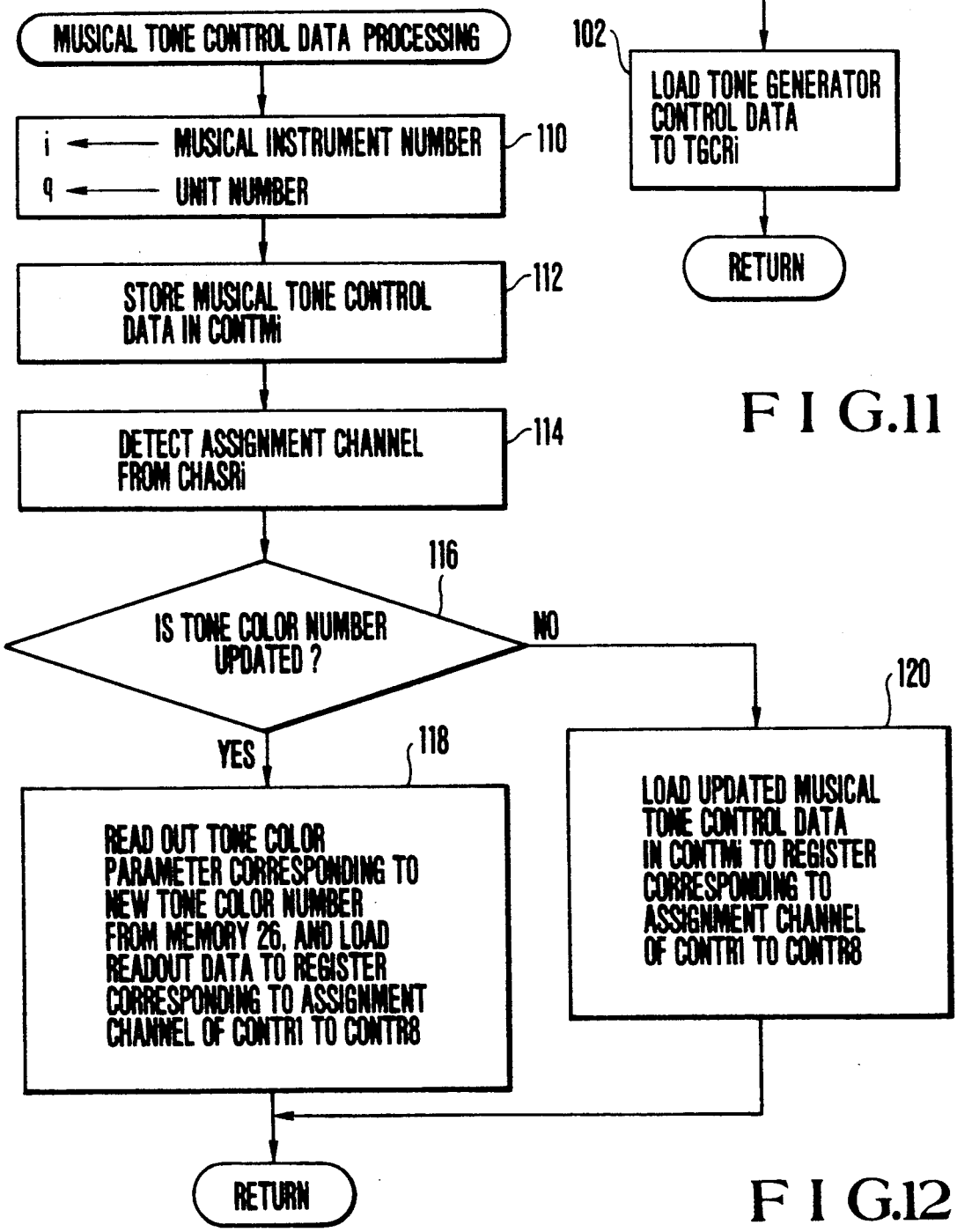
FIG. 12 is a flow chart showing the subroutine of musical tone control data processing.

Musical Tone Control Data Processing (FIG. 12)

The musical tone control data processing shown in FIG. 12 is performed when the musical tone control request is supplied from a specific musical instrument to a specific tone generator unit. In step 110, a musical instrument number associated with the control request is set in the register i, and a unit number associated with the control request is set in the register q. If the musical instrument number is given as i and the unit number is given as q, the processing described with reference to FIG. 12 is performed using registers associated with a tone generator unit of the unit number q and corresponding to the musical instrument number i.

In step 112, input musical tone control data is stored in the musical tone control data memory $CONTM_i$ corresponding to the musical instrument number i. The flow then advances to step 114.

In step 114, an assigned channel or channels are detected with reference to the channel assignment register $CHASR_i$ corresponding to the musical instrument number i.

Thereafter, it is checked in step 116 if tone color number is updated in the register $CONTM_i$ (if a tone color is to be changed). If Y in step 116, the flow advances to step 118. If N in step 116, the flow advances to step 120.

In step 118, a tone color parameter corresponding to new tone color number is read out from the memory 26, and the readout data is loaded to each one of the 8-channel musical tone control data registers $CONTR_1$ to $CONTR_8$ corresponding to the assigned channel or channels. The flow then returns to the main routine shown in FIG. 9.

In step 120, the updated musical tone control data (musical tone parameters such as a tone volume, effects, and the like) in the register $CONTM_i$ is loaded to each one of the registers $CONTR_1$ to $CONTR_8$ corresponding to the assigned channel or channels. The flow then returns to the main routine shown in FIG. 9.

By the processing shown in FIG. 9, some or all of parameters such as a tone color, a tone volume, effects, and the like in each assigned channel can be updated for each tone generator unit. If the channel assignment processing shown in FIG. 10 is executed after the processing shown in FIG. 12 (the channel assignment request is produced after the musical tone control request is output), updated control data such as a tone color, a tone volume, effects and the like can be assigned to newly assigned channels.

Key-on Processing (FIG. 13)

The key-on processing shown in FIG. 13 is executed when a key-on request is sent from a specific musical instrument. In step 130, a musical instrument number associated with the key-on request is set in the register i, and data "1" is set in the register q.

In step 132, the tone generator control data register $TGCR_i$ corresponding to the musical instrument number i in the tone generator unit of the unit number $q=1$ is looked up, and it is checked if a selection condition corresponding to the content of the register can be established. If Y in step 132, the input performance data is received by the tone generator unit of $q=1$, and the flow advances to step 134.

In step 134, the channel assignment register $CHASR_i$ and the channel status register $CHSTR_i$ corresponding to the musical instrument number i are looked up in the tone generator unit of $q=1$, thereby searching an empty channel. The flow advances to step 136 to check if an empty channel is present. If Y in step 136, the flow advances to step 138.

In step 138, a channel j to be used is determined from the empty channel. The flow then advances to step 140, and the key code KC is loaded to the jth channel of the register $CHSTR_i$. This indicates that this channel is in use.

Thereafter, in step 142, the performance data is loaded to the performance data register $PLAYR_j$ corresponding to the channel j in the tone generator unit of $q=1$. As a result, a musical tone signal having a pitch corresponding to the received key code KC can be produced from the tone generator unit of q=1.

After the processing associated with the tone generator unit of q=1 is completed, the flow advances to step 144. If N in step 132 (the selection condition is not established) or if N in step 136 (the tone generator unit of q=1 has no assigned channel or if present, the channel is not empty), the flow also advances to step 144.

It is checked in step 144 if q=Q (processing for all the units is completed). When the processing of the tone generator unit of q=1 is completed, as described above, N is obtained in step 144, and the flow advances to step 146.

In step 146, the value of q is incremented by one. The flow then returns to step 132, and the above-mentioned processing is performed for the tone generator unit of q=2. Thereafter, when the processing of the remaining tone generator units is performed until q =Q, Y is obtained in step 144, and the flow returns to the main routine shown in FIG. 9.

When a plurality of keys are simultaneously depressed in the musical instrument of the musical instrument number i, the key-on requests corresponding to the depressed keys are sequentially received, and the processing shown in FIG. 13 is executed for each key-on request. For this reason, if a given or different tone generator units receive the key codes KC corresponding to a plurality of depressed keys and include a plurality of empty channels, a plurality of musical tone signals corresponding to the plurality of key codes KC can be produced from these channels.

By the processing shown in FIG. 13, when two tone generator units are arranged (Q=2), if the control mode values of both the units are set to be "0", a plurality of musical tone signals corresponding to the input key codes KC are parallel-sent from the two tone generator units, and two tones having the same pitch can be simultaneously produced. If the control mode values of the first and second tone generator units are respectively set to be "1" and "2", and key codes KC of even numbers or odd numbers are supplied, the first tone generator unit sends a musical tone signal corresponding to an even-number key code, and the second tone generator unit sends a musical tone signal corresponding to an odd-number key code. Thus, two tones having different pitches can be produced at the same time.

Figure 14:
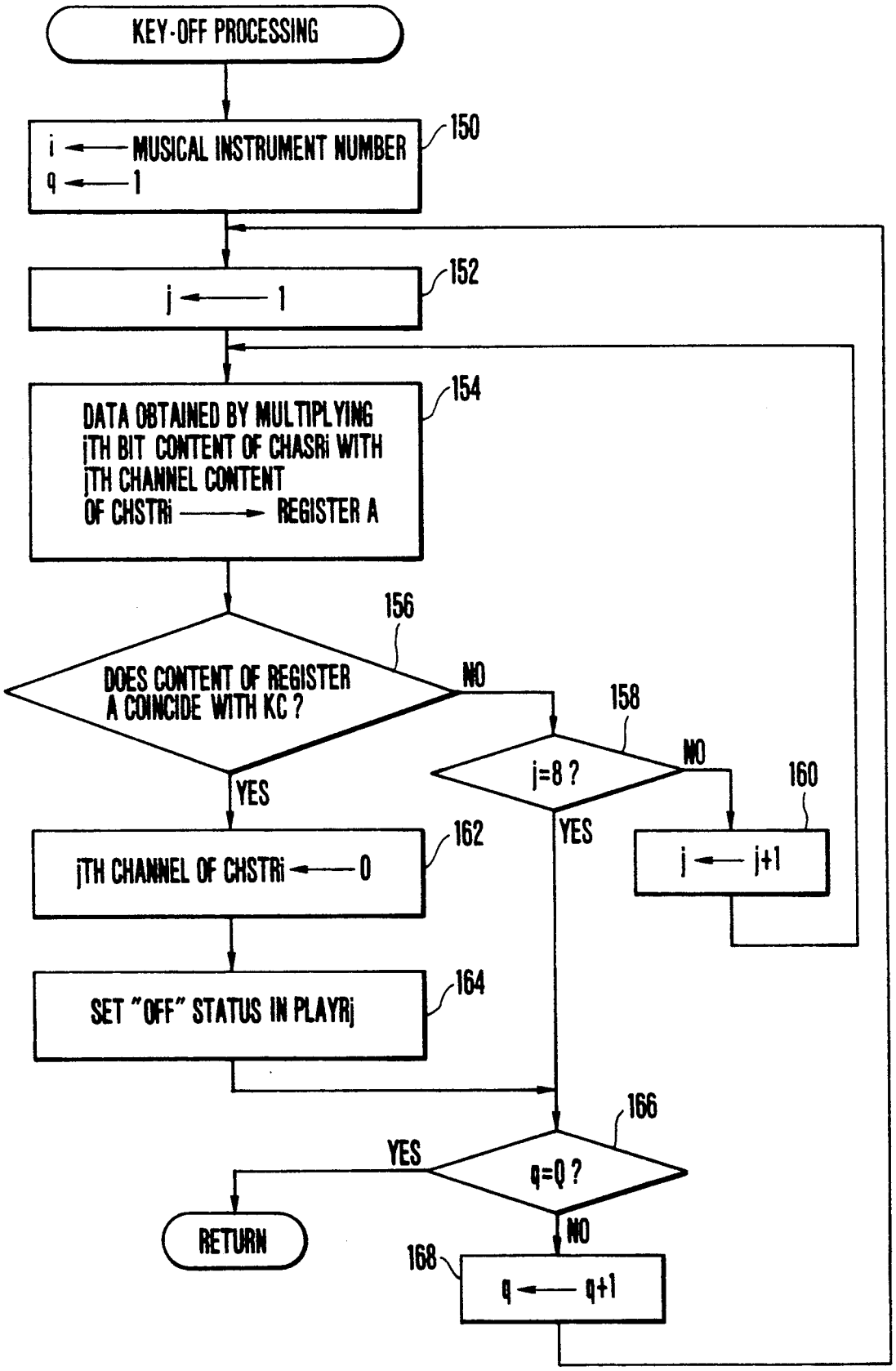
FIG. 14 is a flow chart showing the subroutine showing the subroutine of key-off processing.

Key-off Processing (FIG. 14)

The key-off processing shown in FIG. 14 is executed when a key-off request is sent from a specific musical instrument. In step 150, a musical instrument number associated with the key-off request is set in the register i, and data "1" is set in the register q. In step 152, data "1" is set in the register j, and a channel 1 is selected in the tone generator unit of q=1.

In step 154, the content of a jth bit of the channel assignment register $CHASR_i$ corresponding to the musical instrument number i ("1" or "0") is multiplied with the content of the jth channel of the channel status register $CHSTR_i$ corresponding to the musical instrument number i ("0" or KC), and the resultant product data is loaded to the register A. This processing is performed to check the presence/absence of assignment for each channel and if the corresponding channel is in use. Only when the corresponding channel is assigned and is in use, the key code KC is loaded from the register $CHSTR_i$ to the register A. Thereafter, the flow advances to step 156.

It is checked in step 156 if the content of the register A coincides with the input key code KC. If N in step 156, this means that the corresponding channel is not assigned or is not used, and the flow advances to step 158.

It is checked in step 158 if j=8. When j=1 as described above, N is obtained in step 158, and the flow advances to step 160. In step 160, the value of j is incremented by one. The flow then returns to step 154, and the same processing as above is performed for channel 2. This processing is repeated until j=8 as long as N is obtained in step 156.

If Y in step 156, this indicates that a musical tone corresponding to the key code KC is being produced in the assigned channel j, and the flow advances to step 162. In step 162, data "0" is set in the jth channel of the register $CHSTR_i$. This indicates that this channel is not used. The flow advances to step 164.

In step 164, OFF status data is set in the performance data register $PLAYR_j$ of the jth channel in the tone generator unit of q=1. As a result, a musical tone which is being produced in the channel j is interrupted. Thereafter, the flow advances to step 166. If Y is obtained in step 158 (none of 8 channels are assigned or are used in the tone generator unit of q=1), the flow also advances to step 166.

It is checked in step 166 if q=Q, thereby discriminating if processing for all the units is completed. When the processing of the tone generator unit of q=1 is completed, as described above, N is obtained in step 166, and the flow advances to step 168.

In step 168, the value of q is incremented by one, and the same processing as above is executed for the tone generator unit of q=2. Thereafter, when processing for the remaining tone generator units is performed until q =Q, Y is obtained in step 168, and the flow returns to the main routine shown in FIG. 9.

When a plurality of keys are simultaneously released in the musical instrument of the instrument number i, the key-off requests corresponding to the respective keys are sequentially received, and the processing shown in FIG. 14 is performed for each key-off request. Thus, the musical tones corresponding to key releases are stopped.

Another Embodiment of Key-on Processing (FIG. 15)

The key-on processing shown in FIG. 15 can be used instead of the processing of FIG. 13. Therefore, this processing is executed when a key-on request is sent from a specific musical instrument.

In step 170, a musical instrument number associated with th key-on request is set in the register i and data "1" is set in the register q. In step 172, an empty channel is searched in association with the musical instrument number i in the tone generator unit of unit number q=1, in the same manner as in step 134 described above.

It is checked in step 174 if an empty channel is present. If Y in step 174, the flow advances to step 176, and a channel j to be used is determined from the empty channel. The key code KC is loaded to the jth channel of the register $CHSTR_i$, in step 178, and performance data is loaded to the performance data register $PLAYR_j$ of the jth channel, in step 180. As a result, a musical tone signal having a pitch corresponding to the input key code KC is produced from the tone generator unit of q=1.

Thereafter, in step 182, it is checked if the control mode value is 2. If N in step 182, the flow returns to the main routine shown in FIG. 9.

However, if Y in step 182, the flow advances to step 184, and KC updating processing is performed. In this processing, the value of the key code KC included in the input performance data is updated in accordance with a control parameter, so as to prepare new performance data.

It is checked in step 186 if q=Q. When the processing of the tone generator unit of q=1 is completed, N is obtained in step 186, and the flow advances to step 188.

In step 188, the value of q is incremented by one. The flow then returns to step 172, and the same processing as above is performed for the tone generator unit of q=2.

If N is obtained in step 174, this indicates that processing is impossible in the tone generator unit of q=1, and the flow advances to step 190.

It is checked in step 190 if the control mode value is 1. If Y in step 190, the flow advances to step 188 via step 186, and q=2 is set. The flow then returns to step 172, and the same processing as above is performed for the tone generator unit of q=2.

If N in step 190, the flow advances to step 182, and if the control mode value is not 2, the flow returns to the main routine shown in FIG. 9. This corresponds to a case when the control mode value is 0. More specifically, when the control mode value is 0, a musical tone is produced if the tone generator unit of q=1 has an empty channel in association with the musical instrument number i. However, if no empty channel is present, the processing of the next tone generator unit is not performed.

When the control mode value is 1 or 2, processing of the remaining tone generator units is performed until q =Q is obtained. Then, Y is obtained in step 186, and the flow returns to the main routine shown in FIG. 9.

When the control mode value is 1, it is checked if an empty channel is present in association with the musical instrument number i for each tone generator unit, as described above. If present, the input data is processed in the self-unit, and if absent, the input data is transferred to the next unit. Therefore, the number of tones which can be produced at the same time can be satisfactorily increased.

When the control mode value is 2, it is checked if an empty channel is present in association with the musical instrument number i for each tone generator unit, as described above. If present, the input data is processed in the self-unit, and then, new performance data is prepared by updating, e.g., the code KC, so as to transfer it to the next unit. Therefore, a modulation tone or a chord can be produced.

When a plurality of keys are simultaneously depressed in the musical instrument of the musical instrument number i in the processing shown in FIG. 15, a plurality of musical tone signals can be produced at substantially the same time, in the same manner as in FIG. 13.

According to the present invention as described above, an arbitrary tone color can be assigned to an arbitrary channel, and tone color assignment can be desirably changed. Therefore, a plurality of channels can be effectively utilized, and a performance with desired changes in tone colors can be attained.

What is claimed is:

1. A musical tone generator for generating musical tones in accordance with musical performance data, comprising:

a plurality of tone generator units for producing musical tones, each of said units having a plurality of musical tone generation channels, wherein said musical performance data is transferable between each of said plurality of tone generator units;

storage means incorporated in each of said tone generator units for storing musical tone control data;

input means for inputting said musical performance data necessary for producing musical tones;

discrimination means incorporated in each of said tone generator units for determining, based on said control data corresponding to each of said tone generator units, whether or not said inputter musical performance data can be received therein; and control means for controlling musical tone production, based on said musical performance data received in a predetermined one of said plurality of tone generator units.

2. A generator according to claim 1, wherein the received control data stored in said storage means is input from said input means for each of said tone generator units.

3. A musical tone generator for generating musical tones in accordance with musical performance data, comprising:

a plurality of tone generator units for producing musical tones, each of said units having a plurality of musical tone generation channels, wherein said musical performance data being transferable between each of said plurality of tone generator units;

inputs means for inputting said musical performance data necessary for producing musical tones;

discrimination means incorporated in each of said tone generator units for determining whether or not said inputted musical performance data can be processed therein; and control means for controlling musical tone production in one of said plurality of tone generator units based on said musical performance data when said discrimination means determines that said inputted musical performance data can be processed by said one of said tone generator units, and for controlling musical tone production in another tone generator unit based on said musical performance data when said discrimination means determines that said inputted musical performance data cannot be processed by said one of said plurality of tone generator units.

* * * * *